United States Patent [19]

Yamashita

[11] 4,091,594

[45] May 30, 1978

[54] STRUCTURE FOR CONVECTING PARALLED SPACED VERTICAL SUPPORTS

[76] Inventor: Yujiro Yamashita, 9 Daimon-cho, Nishikyogoku Ukyo-Ward Kyoto-Prefecture, Kyoto City, Japan

[21] Appl. No.: 729,606

[22] Filed: Oct. 4, 1976

[51] Int. Cl.[2] ..... E04C 3/30

[52] U.S. Cl. ..... 52/721; 52/283

[58] Field of Search ..... 52/726, 729, 283, 633, 52/648, 721, 86, 236.3; 404/337, 338, 340

[56] References Cited

U.S. PATENT DOCUMENTS

| | | | |
|---|---|---|---|
| 1,619,631 | 3/1927 | Pataswik | 52/86 |
| 2,424,371 | 7/1947 | Scott | 52/721 |
| 2,685,194 | 8/1954 | Amirikian | 52/283 |

FOREIGN PATENT DOCUMENTS

| | | | |
|---|---|---|---|
| 1,492,250 | 7/1967 | France | 52/86 |
| 446,249 | 3/1949 | Italy | 52/90 |
| 626,097 | 7/1949 | United Kingdom | 52/283 |

OTHER PUBLICATIONS

American Concrete Institute, 1946, p. 371.

*Primary Examiner*—John E. Murtagh
*Attorney, Agent, or Firm*—Wenderoth, Lind & Ponack

[57] ABSTRACT

The present invention pertains to a method which is capable of connecting, most easily and assuredly, the longitudinal steel shapes with beams.

3 Claims, 3 Drawing Figures

PRIOR ART

STRUCTURE FOR CONVECTING PARALLED SPACED VERTICAL SUPPORTS

BACKGROUND OF THE INVENTION

The conventional method of connecting the two longitudinal steel shapes is to weld the shortened beam materials *b* and *b* to face with each other, to a pair of longitudinal materials *a* and *a*, erected on the ground and then, connect the shortened beams *b* and *b*, with a long beam *c*. At the connected parts, the edge of the shortened beam piece *b*, cut at tight angles and the edge of the long beam *c*, are butt jointed together; then to the ribs on both sides of the butt jointed ends, the patch plates, *d* and *d*, and to the upper and lower flanges, the patch plates *e* and *e*, are fixed for connection. However, in this work it is necessary to lighten the connection with lots of bolts and nuts and, therefore, the work involves troubles and requires lengthly hours in addition to the bolts, nuts and patch plates.

Furthermore, the hole drilling has to be performed on the patch plates for numerous bolts to make the work highly uneconomical.

To make the situation still worse, until the tightening work with the bolts and nuts is completed the beam materials have to be constantly supported by the cranes or the like with dangerous probabilities for their dropping down. Thus, it bears a defect in that the work has to be progressed in an uneasy condition constantly.

SUMMARY OF THE INVENTION

The primary object of the present invention is to offer a method of connection which dissolves poorness of the work efficiency with the conventional method of connection as mentioned above and to shorten the working time.

The secondary object is to offer a method to save the materials and reduce the expenses required for construction. The third of the object is to offer a connnection method capable of dissolving dangerous probabilities with the conventional method and to assure the work constantly in a stablized condition even though with no help of scaffolds.

These objects will be clarified by the attached drawings and the detailed explanations below described.

The explanations on the drawing are as follows.

Figure 1:
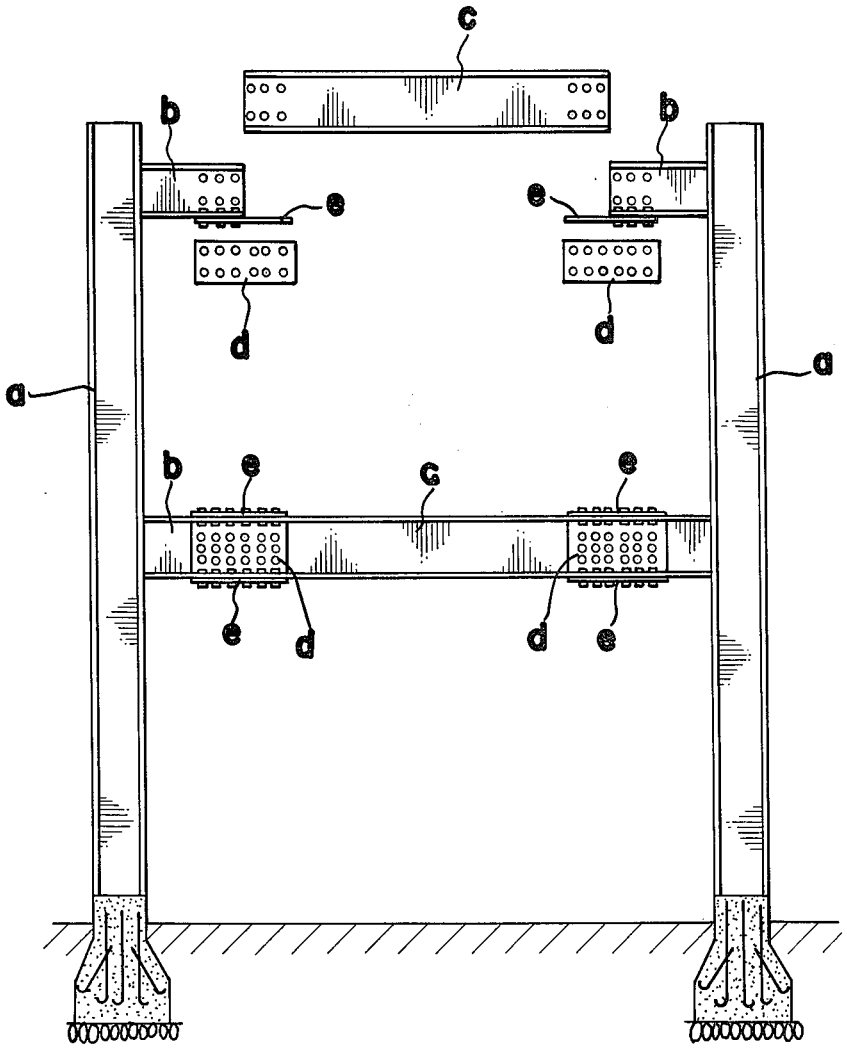
FIG. 1 is the front view showing the connecting condition of longitudinal materials according to the conventional method.
Figure 2:
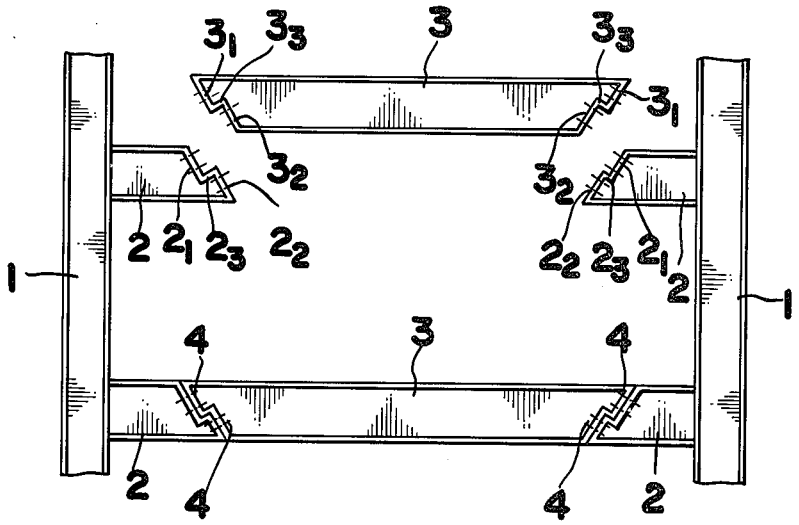
FIG. 2 is the front view of the important parts of the connecting condition of longitudinal materials according to the method of the invention.
Figure 3:
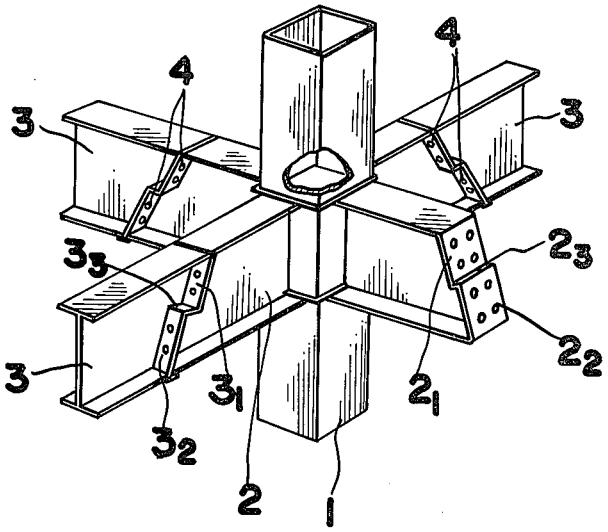
FIG. 3 is the oblique view of the same important parts. Hereunder mentioned is the explanation on the connecting method of longitudinal steel shapes according to the present invention with reference to the example of actual works shown in the drawings.

To a pair of the longitudinal material 1 and 1, erected in parallel on the ground, the ends of the shortened beam pieces 2 and 2 facing with each other, are welded for tight fixing: and in fixing the both ends of the longer beam 3, to the ends of the aforementioned beam pieces, 2 and 2, work up this connected part as follows. To the end of the shortened beam 2, which is the connected part, the oblique flanges $\mathbf{2}_1$ and $\mathbf{2}_2$ both slanting inward by about 60° in parallel and stepped, are to be fixed to form up the flange part $\mathbf{2}_3$ which is to connect the oblique flanges $\mathbf{2}_1$ and $\mathbf{2}_2$, at right angles. Then, to each end of the long beam 3, the aforementioned oblique flanges $\mathbf{2}_1$ and $\mathbf{2}_2$, are connected. Next, finish up the oblique flanges, $\mathbf{3}_1$, and $\mathbf{3}_2$ and the connecting flange $\mathbf{3}_3$ around the connecting flange $\mathbf{2}_3$, and connect the flanges $\mathbf{3}_1$, $\mathbf{3}_2$ and $\mathbf{3}_3$, at both ends of the longer beam 3, are to be faced with the flanges $\mathbf{2}_1$, $\mathbf{2}_2$ and $\mathbf{2}_3$, for support; then the flanges $\mathbf{2}_1$, $\mathbf{3}_1$, $\mathbf{2}_2$ and $\mathbf{3}_2$, are to be tightened respectively to each other with bolts and nuts 4 and 4 for final connection to the bam materials 2, 3 and 2. The process explained above is the characteristic of the present invention.

As so far described, according to the longitudinal material connecting method of the present invention it is to have the shortened beam pieces protruded inward from a pair of the longitudinal materials to face each other and at their ends, the oblique and connecting flange parts are arranged. To the both ends of the long beam for connection of the longitudinal materials, the flanges to face the aforementioned flanges are fixed to face with each other and then, they are securely tightened with bolts and nuts. Therefore, by placing only the flanged part at each end of the long beam upon the flange at the other end of the beam piece protruding from the longitudinal material, the both ends of the beam material can be perfectly supported dispensing with the whole troubles to keep the beam materials supported with bolts and nuts whole through the duration of the work up to its completion as has been conventionally in practice so far. Even while working on the beam, there is no fear for his falling down unless a force is applied from a horizontal direction to assure a high rate of security. Not only that, suffice it to control horizontal movements between the vertical materials. The bolts and nuts required for tightening are extremely limited and the patch plates, etc. are also not required altogether and thus, the materials can be notably economised. Assuring possibilities of material saving by the shortening of work hours relative to the reduction in the numbers of bolts and nuts for use, plus no necessity of erecting the scaffolds, this is an apoch-making method of connection which makes possible a drastic saving of the construction expense.

What is claimed is:

1. A structure for connecting parallel, spaced vertical supports comprising:

two first beams aligned with each other and attached opposite each other one on each vertical support, each first beam having an angled end face angled upward toward said vertical support to which it is attached on the end thereof opposite the end attached to said support, said angled end face being comprised of at least two parallel angled surfaces angled at approximately 60° with respect to the longitudinal direction of said beam and a third surface at right angles to and joining said parallel surfaces;

a second beam contacting and extending between said angled end surfaces of said first beams, said second beam also having a plurality of parallel angled surfaces at the ends thereof angled correspondingly to said angled surfaces of said first beams, whereby said angled end surfaces of said second beam rest directly against the said angled surfaces of said first beams; and fastening means between said contacting end surfaces of said first and second beams for fastening said contacting surfaces together.

2. A structure as claimed in claim 1 wherein said first beam pieces are welded to said second beams.

3. A structure as claimed in claim 1 wherein said fastening means is comprised of a plurality of bolts through said contacting end faces and nuts connected to said bolts.

* * * * *